US011674658B2

(12) United States Patent
Fujita

(10) Patent No.: US 11,674,658 B2
(45) Date of Patent: Jun. 13, 2023

(54) HEADLAMP FOR VEHICLE

(71) Applicant: KOITO MANUFACTURING CO., LTD., Tokyo (JP)

(72) Inventor: Shoji Fujita, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 17/612,342

(22) PCT Filed: Apr. 25, 2020

(86) PCT No.: PCT/JP2020/017874
§ 371 (c)(1),
(2) Date: Nov. 18, 2021

(87) PCT Pub. No.: WO2020/235301
PCT Pub. Date: Nov. 26, 2020

(65) Prior Publication Data

US 2022/0205610 A1 Jun. 30, 2022

(30) Foreign Application Priority Data

May 22, 2019 (JP) ..... JP2019-095738

(51) Int. Cl.
*F21S 41/33* (2018.01)
*F21S 41/148* (2018.01)
(Continued)

(52) U.S. Cl.
CPC ..... *F21S 41/33* (2018.01); *F21S 41/148* (2018.01); *F21S 41/151* (2018.01); *F21V 7/06* (2013.01); *F21Y 2115/10* (2016.08)

(58) Field of Classification Search
CPC ..... F21V 7/06; F21Y 2115/10; F21S 41/148; F21S 41/32; F21S 41/321; F21S 41/323;
(Continued)

(56) References Cited

U.S. PATENT DOCUMENTS 10,378,716 B2 * 8/2019 Sato ..... F21S 41/00
2013/0314936 A1 * 11/2013 Yamamura ..... F21S 41/155 362/516
(Continued)

FOREIGN PATENT DOCUMENTS

EP 2620694 A2 * 7/2013 ..... F21S 41/143
FR 2984457 A1 * 6/2013 ..... B60Q 1/0041
(Continued)

OTHER PUBLICATIONS

International Search Report (PCT/ISA/210) dated Jul. 7, 2020 by the International Searching Authority in counterpart international Patent Application No. PCT/JP2020/017874.
(Continued)

*Primary Examiner* — Erin Kryukova
(74) *Attorney, Agent, or Firm* — Sughrue Mion, PLLC

(57) ABSTRACT

A vehicle headlamp includes a reflector having plural reflecting surfaces arranged in a left-right direction, and n light sources which are arranged in the left-right direction and emit light toward any one of the reflecting surfaces. At least two adjacent light sources are provided as a common light source which emits light toward a same reflecting surface. n illumination patterns which illuminate different regions in the left-right direction are formed by light emitted from the n light sources, respectively, and are taken as a first to n-th illumination patterns in this order in the left-right direction. At least half of areas of illumination patterns of an immediately-following number and an immediately-preceding number overlap each other in the left-right direction. Focal lengths of the plural reflecting surfaces are set such that adjacent illumination patterns which do not overlap each other are formed by light emitted from the common light source.

5 Claims, 5 Drawing Sheets

(51) Int. Cl.
*F21S 41/151* (2018.01)
*F21V 7/06* (2006.01)
*F21Y 115/10* (2016.01)

(58) Field of Classification Search
CPC ..... F21S 41/33; F21S 41/337; F21S 41/36; F21S 41/151; F21S 41/663
See application file for complete search history.

(56) References Cited

U.S. PATENT DOCUMENTS

| | | | | |
|---|---|---|---|---|
| 2015/0062948 | A1* | 3/2015 | Otsubo | F21S 41/43 362/509 |
| 2016/0084465 | A1 | 3/2016 | Yamamoto | |
| 2016/0091161 | A1 | 3/2016 | Naganawa | |
| 2016/0368414 | A1* | 12/2016 | Son | F21S 41/663 |
| 2017/0153000 | A1* | 6/2017 | Sato | F21S 41/147 |
| 2017/0232882 | A1* | 8/2017 | Mochizuki | F21S 41/657 362/516 |

FOREIGN PATENT DOCUMENTS

| | | | |
|---|---|---|---|
| JP | 2013-243080 | A | 12/2013 |
| JP | 2017-147131 | A | 8/2017 |
| JP | 2017-224468 | A | 12/2017 |

OTHER PUBLICATIONS

Written Opinion (PCT/ISA/237) dated Jul. 7, 2020 by the International Searching Authority in counterpart international Patent Application No. PCT/JP2020/017874.

* cited by examiner

HEADLAMP FOR VEHICLE

TECHNICAL FIELD

The present invention relates to a vehicle headlamp in which light emitted from a plurality of light sources under on/off control is reflected by a reflecting surface of a reflector.

BACKGROUND ART

A vehicle headlamp is configured such that components such as a plurality of light sources and a reflector are provided in a lamp room which is an internal space of a lamp outer housing configured by a lamp housing and a cover, and on/off of the plurality of light sources are controlled based on a traveling state of a vehicle (for example, see Patent Document 1).

A vehicle headlamp described in Patent Document 1 is configured to perform a so-called adaptive driving beam (ADB) control in which a light source which illuminates a region of another vehicle such as a preceding vehicle detected by processing an image obtained by a camera is turned off to change a light distribution pattern of a high beam.

In the vehicle headlamp described in Patent Document 1, light is individually emitted from a plurality of semiconductor light emitting elements (LED) which are provided as light sources arranged side by side in the left-right direction, respective illumination patterns are formed by light emitted from those light sources, and a light distribution pattern of forward illuminating light is formed by such illumination patterns.

This control can prevent or reduce dazzling light to another vehicle such as a preceding vehicle.

CITATION LIST

Patent Document

Patent Document 1: JP-A-2013-243080

SUMMARY OF INVENTION

Technical Problem

In recent years, due to sophisticated design of a vehicle and the like, a vehicle body has various shapes. Accordingly, demand increases in a vehicle headlamp for a size reduction and a thin shape with a smaller upper-lower width.

In a vehicle headlamp using a reflector and having the ADB function as described above, in order to reduce a size of the vehicle headlamp, particularly the upper-lower width thereof, it is considered to reduce, for example, a focal length of a reflecting surface of the reflector and reduce curvature of the reflecting surface.

While reducing the focal length of the reflecting surface, a reflector having a smaller upper-lower width can be used to reduce the size of the vehicle headlamp. However, a position of an illumination pattern of light emitted from the light source shifts in the left-right direction along with a change in the focal length, so that luminance unevenness may occur in the light distribution pattern formed by the illumination patterns.

Accordingly, an object of the present invention is to reduce a size of a vehicle headlamp while reducing luminance unevenness in a light distribution pattern.

Solution to Problem

According to a first aspect of the present invention, a vehicle headlamp includes a reflector which has a plurality of reflecting surfaces arranged in a left-right direction, and n light sources which are arranged in the left-right direction and each of which is configured to emit light toward any one of the reflecting surfaces. At least two of the light sources positioned adjacent to each other are provided as a common light source which is configured to emit light toward a same reflecting surface. n illumination patterns which illuminate different regions in the left-right direction are formed by light emitted from the n light sources, respectively. The n illumination patterns are taken as a first illumination pattern to an n-th illumination pattern in this order in the left-right direction. At least half of an area of an illumination pattern of an immediately-following number overlaps at least half of an illumination pattern of an immediately-preceding number in the left-right direction. Focal lengths of the plurality of reflecting surfaces are set such that adjacent illumination patterns which do not overlap each other are formed by light emitted from the common light source.

Accordingly, in a state where at least half of areas of the illumination patterns respectively formed by light emitted from the light sources overlap each other in the left-right direction, adjacent illumination patterns which do not overlap each other are formed by light emitted from the common light source.

According to a second aspect of the present invention, in the vehicle headlamp described above, it is preferable that the focal lengths be set to range from 10 mm to 15 mm.

Accordingly, the curvature of the reflector is sufficiently small.

According to a third aspect of the present invention, in the vehicle headlamp described above, it is preferable that the common light source be configured by two of the light sources.

Accordingly, the number of reflecting surfaces can be increased without excessively increasing the size of the reflecting surface corresponding to the common light source.

According to a fourth aspect of the present invention, in the vehicle headlamp described above, it is preferable that the common light source be provided in plural.

Accordingly, the number of reflecting surfaces is largely reduced relative to the number of light sources.

According to a fifth aspect of the present invention, in the vehicle headlamp described above, it is preferable that at least one of the light sources be provided as a non-common light source which is not the common light source.

Accordingly, the degree of freedom in an arrangement of the plurality of light sources is improved in relation to the plurality of reflecting surfaces.

Effects of the Invention

According to the present invention, in a state where at least half of areas of the illumination patterns respectively formed by light emitted from the light sources overlap one another in the left-right direction, adjacent illumination patterns which do not overlap each other are formed by light emitted from a common light source. Therefore, the focal lengths of reflecting surfaces of the reflector can be reduced while forming the light distribution pattern in which luminance unevenness is less likely to occur, and the size of the vehicle headlamp can be reduced while reducing the luminance unevenness in the light distribution pattern.

DESCRIPTION OF EMBODIMENTS

Hereinafter, a vehicle headlamp according to embodiments of the present invention will be described with reference to the accompanying drawings.

A vehicle headlamp 1 is each mounted on left and right end portions of a front end portion of a vehicle body.

Figure 1:
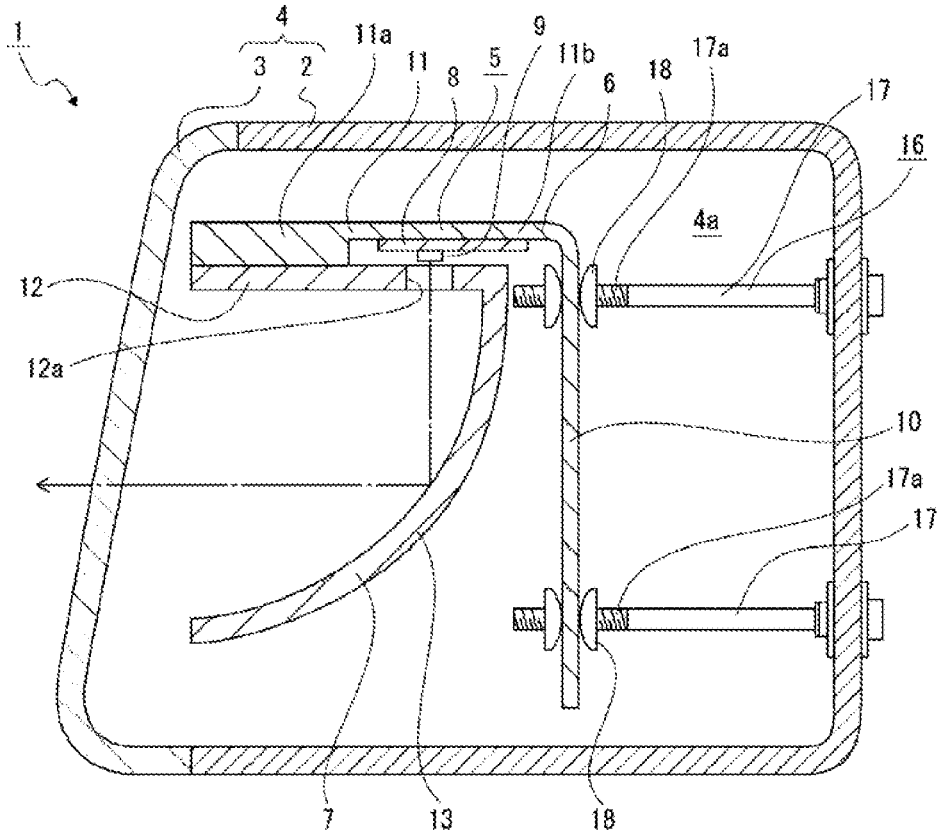
FIG. 1 shows a vehicle headlamp according to an embodiment of the present invention together with FIGS. 2 to 8 and is a cross sectional view thereof.

The vehicle headlamp 1 includes a lamp housing 2 having an opening at a front end thereof and a cover 3 attached to the lamp housing 2 so as to close the opening of the lamp housing 2 (see FIG. 1). The lamp housing 2 and the cover 3 constitute a lamp outer housing 4. An internal space of the lamp outer housing 4 is formed as a lamp room 4*a*.

A lamp unit 5 is disposed in the lamp room 4*a*. The lamp unit 5 includes a bracket 6, a reflector 7, a substrate 8, and light sources 9, 9 . . . .

The bracket 6 includes a plate-shaped coupling portion 10 facing a front-rear direction and a plate-shaped attaching portion 11 facing an upper-lower direction. An upper end portion of the coupling portion 10 and a rear end portion of the attaching portion 11 are continuous with each other. The attaching portion 11 includes a front half portion which is thicker than a rear half portion, as a reflector attaching portion 11*a*, and the rear half portion as a substrate attaching portion 11*b*. A lower surface of the reflector attaching portion 11*a* is positioned below a lower surface of the substrate attaching portion 11*b*.

The reflector 7 has a plate-shaped attached portion 12 facing the upper-lower direction and a reflecting portion 13 formed into a curved surface shape which is displaced forward as proceeding downward. A rear end portion of the attached portion 12 and an upper end portion of the reflecting portion 13 are continuous with each other. A light transmission hole 12*a* is formed in the attached portion 12. The reflecting portion 13 is divided into, for example, four portions in the left-right direction (see FIG. 2). Inner surfaces of the four portions of the reflecting portion 13 are receptively formed as a first reflecting surface 13*a*, a second reflecting surface 13*b*, a third reflecting surface 13*c*, and a fourth reflecting surface 13*d* in this order from an inner side to an outer side in the left-right direction of the vehicle. Each of the first reflecting surface 13*a*, the second reflecting surface 13*b*, the third reflecting surface 13*c*, and the fourth reflecting surface 13*d* is formed as a paraboloidal surface which is convex obliquely downward and rearward.

In the reflector 7, focal lengths of the first reflecting surface 13*a*, the second reflecting surface 13*b*, the third reflecting surface 13*c*, and the fourth reflecting surface 13*d* are set to range, for example, from 10 mm to 15 mm. A front half portion of the attached portion 12 of the reflector 7 is attached to the reflector attaching portion 11*a* of the bracket 6, and the reflector 7 is positioned at a front side of the coupling portion 10 (see FIG. 1).

Figure 2:
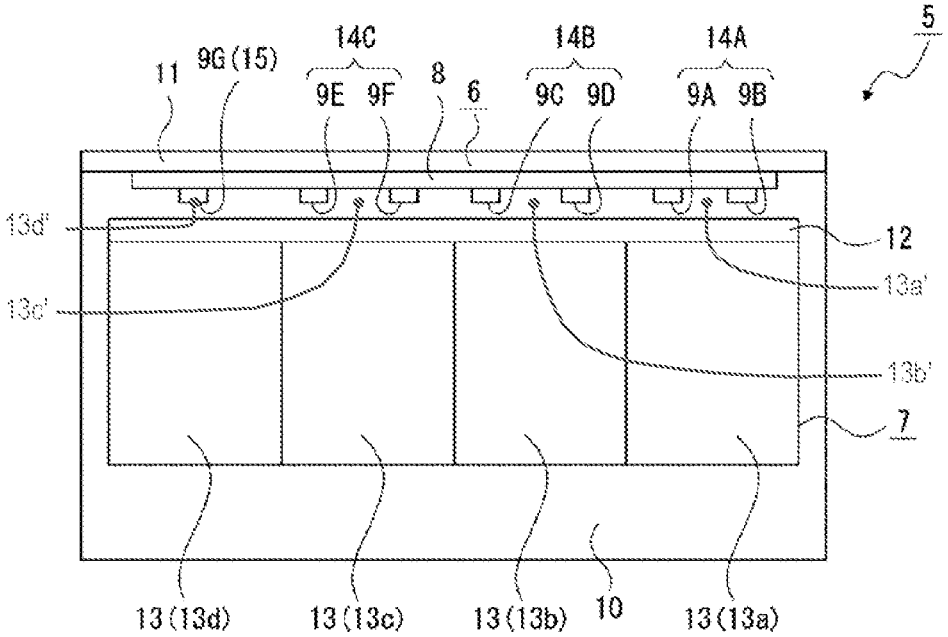
FIG. 2 is a schematic front view showing a lamp unit.

The substrate 8 is formed into a long shape in the left-right direction and is attached to the lower surface of the substrate attaching portion 11*b* of the bracket 6 (see FIG. 2). The substrate 8 is connected to a control circuit (not shown).

The light sources 9, 9 . . . are mounted on a lower surface of the substrate 8 so as to be spaced apart from one another in the left-right direction. Each of the light sources 9, 9 . . . is a light emitting diode (LED). For example, seven light sources 9 are provided. That is, the number n of the light sources 9 is seven. Light emitted from the light sources 9, 9 . . . is transmitted through the transmission hole 12*a*, travels toward the reflecting portion 13 of the reflector 7, is reflected by the reflecting portion 13, is transmitted through the cover 3, and is radiated forward (see FIG. 1).

The light sources 9, 9 . . . include a second light source 9B, a first light source 9A, a fourth light source 9D, a third light source 9C, a sixth light source 9F, a fifth light source 9E, and a seventh light source 9G in this order from the inner side to the outer side in the left-right direction of the vehicle (see FIG. 2).

The second light source 9B and the first light source 9A are provided as a first common light source 14A from which light is emitted toward the first reflecting surface 13*a*, the fourth light source 9D and the third light source 9C are provided as a second common light source 14B from which light is emitted toward the second reflecting surface 13*b*, and the sixth light source 9F and the fifth light source 9E are provided as a third common light source 14C from which light is emitted toward the third reflecting surface 13*c*. The seventh light source 9G is provided as a non-common light source 15, and light emitted from the seventh light source 9G travels toward the fourth reflecting surface 13*d*.

The lamp unit 5 configured as described above is tiltable in a horizontal direction and a vertical direction relative to the lamp outer housing 4 via a light axis adjustment mechanism 16 (see FIG. 1).

The light axis adjustment mechanism 16 includes aiming screws 17, 17 and a pivot fulcrum point portion (not shown). Each of the aiming screws 17, 17 extends in the front-rear direction and includes screwing portions 17*a*, 17*a* at front end portions thereof. The aiming screws 17, 17 are coupled to the coupling portion 10 of the bracket 6 via nut members 18, 18 in a state where the screwing portions 17*a*, 17*a* are respectively screwed to the nut members 18, 18, and rear end portions of the aiming screws 17, 17 are rotatably coupled to the lamp housing 2 in a state where the aiming screws 17, 17 cannot move in the front-rear direction. The coupling portion 10 of the bracket 6 is coupled to the lamp housing 2 via the pivot fulcrum point portion, and the bracket 6 is rotatable in any direction relative to the lamp housing 2 with the pivot fulcrum point portion serving as a fulcrum point.

In the vehicle headlamp 1, when one aiming screw 17 is rotated, the bracket 6 is tilted in a direction corresponding to a rotation direction of the aiming screw 17 with the other aiming screw 17 and the pivot fulcrum point portion serving as a fulcrum point, so that light axis adjustment of the bracket 6 is performed.

The vehicle headlamp 1 may be provided with a so-called leveling adjustment mechanism which adjusts a direction of a light axis inclined according to the weight of an on-vehicle object.

The vehicle includes a camera (not shown) which obtains an image of a state in an illumination region of the vehicle headlamp 1 and a detection unit (not shown) which detects a state of the illumination region based on image data of the camera. In the vehicle headlamp 1, on/off of the light sources 9, 9 . . . is controlled by the control circuit according to a detection result of the detection unit.

As described above, in the vehicle headlamp 1, the on/off of the light sources 9, 9 . . . is controlled according to the detection result of the detection unit. Accordingly, a function of a so-called adaptive driving beam (ADB) is realized which turns off the light source 9 illuminating a region where another vehicle such as a preceding vehicle which is detected, for example, by processing an image obtained by the camera so as to change a light distribution pattern of a high beam.

In the vehicle headlamp 1, illumination patterns 20, 20 . . . are formed by light emitted from the light sources 9, 9 . . . , respectively. The illumination patterns 20, 20 . . . are respectively formed as a first illumination pattern 20A, a second illumination pattern 20B, a third illumination pattern 20C, a fourth illumination pattern 20D, a fifth illumination pattern 20E, a sixth illumination pattern 20F, and a seventh illumination pattern 20G in an order. A light distribution pattern 21 of the vehicle headlamp 1 is formed by the first illumination pattern 20A, the second illumination pattern 20B, the third illumination pattern 20C, the fourth illumination pattern 20D, the fifth illumination pattern 20E, the sixth illumination pattern 20F, and the seventh illumination pattern 20G (see FIG. 3). That is, the number of the illumination patterns 20 is the same as the number of the light sources 9, and the number n of the illumination patterns 20 is seven.

In the following description, to simplify the description, the first illumination pattern 20A, the second illumination pattern 20B, the third illumination pattern 20C, the fourth illumination pattern 20D, the fifth illumination pattern 20E, the sixth illumination pattern 20F, and the seventh illumination pattern 20G are simply referred to as the illumination pattern 20A, the illumination pattern 20B, the illumination pattern 20C, the illumination pattern 20D, the illumination pattern 20E, the illumination pattern 20F, and the illumination pattern 20G, respectively.

Figure 3:
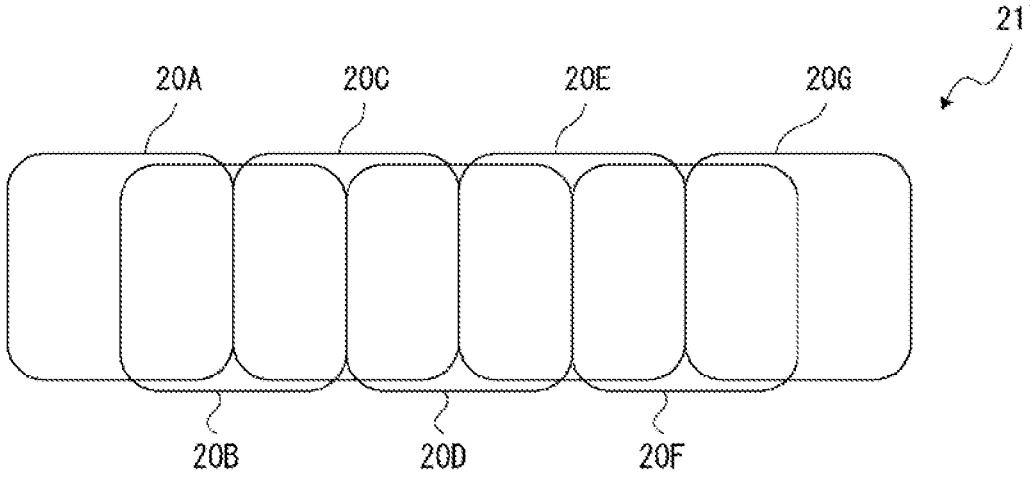
FIG. 3 is a schematic diagram showing an illumination pattern.

The illumination patterns 20A, 20B . . . 20G are formed in this order from the inner side to the outer side in the left-right direction of the vehicle and illuminate different regions in the left-right direction. The illumination patterns 20A, 20B . . . 20G are formed such that half portions of illumination patterns 20, 20 adjacent to each other in the left-right direction overlap each other. In FIG. 3, in order to facilitate understanding of the regions of the illumination patterns 20A, 20B . . . , and 20G, those are shown in a state where the illumination patterns 20A, 20C, 20E, and 20G and the illumination patterns 20B, 20D, and 20F are slightly displaced up and down.

Hereinafter, a relationship between formation positions of the illumination patterns 20, 20 . . . and the light emitted from the light sources 9, 9 . . . will be described (see FIG. 4).

In the following, in order to facilitate the understanding of the configuration of the vehicle headlamp 1, the configuration of the vehicle headlamp 1 will be described after explaining a configuration of a related-art vehicle headlamp X having an ADB function. In FIG. 4, an uppermost diagram schematically shows a positional relationship among the reflecting surfaces 13*a* to 13*d* and the light sources 9, 9 . . . . In order to facilitate a comparison between the vehicle headlamp 1 and the related-art vehicle headlamp X, FIG. 4 shows an example in which the related-art vehicle headlamp X also forms illumination patterns by the similar configuration to the vehicle headlamp 1 shown in the uppermost diagram of FIG. 4.

Figure 4:
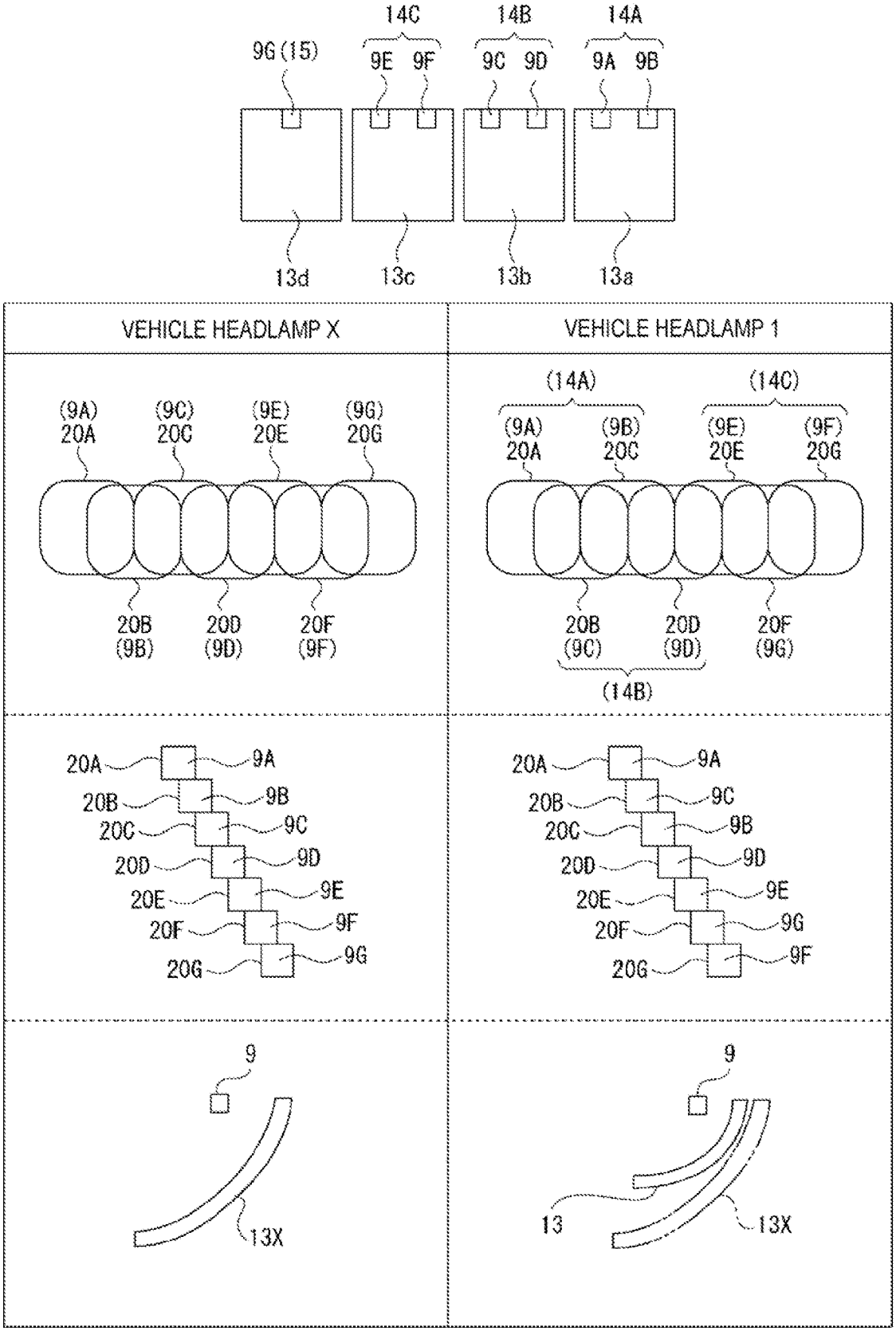
FIG. 4 is a diagram showing a difference or the like in light sources forming respective illumination patterns in comparison with a related-art vehicle headlamp.

In a comparison table between the vehicle headlamp X and the vehicle headlamp 1 in FIG. 4, an upper diagram is a schematic diagram showing which light source forms an illumination pattern, a middle diagram is a schematic diagram showing a relationship between illumination patterns and light sources which form the corresponding illumination patterns, and a lower diagram is a schematic diagram showing a shape of a reflector.

In the vehicle headlamp X, the illumination patterns arranged in the order in the left-right direction are formed by light reflected by reflecting surfaces arranged in the order in the left-right direction.

Specifically, the illumination patterns 20A, 20B are respectively formed by light which is emitted from the first light source 9A and the second light source 9B and is reflected by the first reflecting surface 13*a*, the illumination patterns 20C, 20D are respectively formed by light which is emitted from the third light source 9C and the fourth light source 9D and is reflected by the second reflecting surface 13*b*, the illumination patterns 20E, 20F are respectively formed by light which is emitted from the fifth light source 9E and the sixth light source 9F and is reflected by the third reflecting surface 13*c*, and the illumination pattern 20G is formed by light which is emitted from the seventh light source 9G and is reflected by the fourth reflecting surface 13*d*. At this time, the focal lengths of the first reflecting surface 13*a*, the second reflecting surface 13*b*, the third reflecting surface 13*c*, and the fourth reflecting surface 13*d* in the vehicle headlamp X are, for example, about 20 mm. Focal point 13*a*' of the first reflecting surface 13*a*, focal point 13*b*' of the second reflecting surface 13*b*, focal point 13*c*' of the third reflecting surface 13*c*, and focal point 13*d*' of the fourth reflecting surface 13*d* are shown in FIG. 2.

In the above-described vehicle headlamp X, a good ADB function is provided, and since respective half portions of the illumination patterns 20, 20 adjacent to each other in the left-right direction overlap each other, luminance unevenness is less likely to occur in a light distribution.

However, it may be advantageous to develop a vehicle headlamp having a smaller upper-lower width in order to follow sophisticated design of a vehicle in recent years, and it may be advantageous to reduce a size of a reflector while a basic configuration of the vehicle headlamp X is maintained. In order to reduce the size of the reflector, it is considered to reduce a focal length of a reflecting surface of the reflector to be smaller than a focal length of a reflecting surface of the vehicle headlamp X.

If the focal length of the reflecting surface is reduced, curvature of the reflecting surface increases and the upper-lower width of the reflector can be reduced, so that the size of the vehicle headlamp can be reduced.

However, if the focal length of the reflecting surface is reduced, an illumination pattern formed by light emitted from a light source shifts in the left-right direction, so that an overlapping manner of illumination patterns changes and luminance unevenness is likely to occur. For example, when the focal length of the reflecting surface is reduced by about several millimeters relative to a reflecting surface of a reflecting portion 13X of the vehicle headlamp X while the basic configuration of the vehicle headlamp X is maintained, for example, the illumination pattern 20B formed by light emitted from the light source 9B shifts in a direction away from the illumination pattern 20A.

Accordingly, in the lamp unit 5 of the vehicle headlamp 1, the focal lengths of the first reflecting surface 13*a*, the second reflecting surface 13*b*, the third reflecting surface 13*c*, and the fourth reflecting surface 13*d* are further reduced by about several millimeters relative to a reflecting surface of the reflecting portion 13X of the vehicle headlamp X. As will be specifically described below, at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source. Hereinafter, a case where half of areas of illumination patterns overlap one another will be described as an example.

Specifically, as shown in the right side of FIG. 4, the illumination patterns 20A, 20C are formed by light which is emitted from the first light source 9A and the second light source 9B and is reflected by the first reflecting surface 13*a*, the illumination patterns 20B, 20D are formed by light which is emitted from the third light source 9C and the fourth light source 9D and is reflected by the second reflecting surface 13*b*, the illumination patterns 20E, 20G are formed by light which is emitted from the fifth light source 9E and the sixth light source 9F and is reflected by the third reflecting surface 13*c*, and the illumination pattern 20F is formed by light which is emitted from the seventh light source 9G and is reflected by the fourth reflecting surface 13*d*.

That is, adjacent illumination patterns 20A, 20C are formed by light emitted from the first light source 9A and the second light source 9B which constitute the first common light source 14A, adjacent illumination patterns 20B, 20D are formed by light emitted from the third light source 9C and the fourth light source 9D which constitute the second common light source 14B, and adjacent illumination patterns 20E, 20F are formed by light emitted from the fifth light source 9E and the sixth light source 9F which constitute the third common light source 14C. An overlapping manner of the illumination patterns 20, 20 . . . is similar to the overlapping manner of the vehicle headlamp X. That is, half of an area of the illumination pattern 20B overlaps half of an area of the illumination pattern 20A, half of an area of the illumination pattern 20C overlaps half of an area of the illumination pattern 20B, half of an area of the illumination pattern 20D overlaps half of an area of the illumination pattern 20C, half of an area of the illumination pattern 20E overlaps half of an area of the illumination pattern 20D, half of an area of the illumination pattern 20F overlaps half of an area of the illumination pattern 20E, and half of an area of the illumination pattern 20G overlaps half of an area of the illumination pattern 20F.

In the vehicle headlamp 1, the focal lengths of the first reflecting surface 13*a*, the second reflecting surface 13*b*, the third reflecting surface 13*c*, and the fourth reflecting surface 13*d* are set to range, for example, from 10 mm to 15 mm.

As described above, even in a case where a focal length of a reflecting surface is reduced, if at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source, luminance unevenness is less likely to occur in a light distribution of the vehicle headlamp 1.

As described above, in the vehicle headlamp 1, at least half of an area of the illumination pattern 20 of an immediately-following number overlaps at least half of an area of the illumination pattern 20 of an immediately-preceding number in the left-right direction, and the focal lengths of the reflecting surfaces (13*a* to 13*d*) are set such that adjacent illumination patterns 20, 20 (20A and 20C, 20B and 20D, 20E and 20G) which do not overlap each other are formed by light emitted from the common light sources (14A to 14C), respectively.

Accordingly, in a state where at least half of areas of the illumination patterns 20 respectively formed by light emitted from the light sources 9 overlap one another in the left-right direction, adjacent illumination patterns 20, 20 which do not overlap each other are formed by light emitted from the common light sources (14A to 14C). Therefore, the focal lengths of the reflecting surfaces (13*a* to 13*d*) can be reduced while forming the light distribution pattern 21 in which the luminance unevenness is less likely to occur, and the size of the vehicle headlamp 1 can be reduced while reducing the luminance unevenness in the light distribution pattern 21.

Since the focal lengths of the first reflecting surface 13*a*, the second reflecting surface 13*b*, the third reflecting surface 13*c*, and the fourth reflecting surface 13*d* are set to range from 10 mm to 15 mm, curvature of the reflector 7 is sufficiently large and a size of the reflector 7 is sufficiently small. Accordingly, the size of the vehicle headlamp 1 can be reduced.

Further, since each of the first common light source 14A, the second common light source 14B, and the third common light source 14C is constituted by two light sources 9, 9, the number of reflecting surfaces 13 can be increased without excessively increasing the size of the reflecting surfaces 13 corresponding to the common light sources 14, and the degree of freedom of light distribution control can be improved while reducing the size of the vehicle headlamp 1.

Further, in the vehicle headlamp 1, since a plurality of common light sources 14 are provided, the number of the reflecting surfaces 13 is largely reduced relative to the number of the light sources 9, and the size of the vehicle headlamp 1 can be reduced in the left-right direction while improving the degree of freedom of light distribution control.

In addition, at least one light source 9 (9G) is provided as the non-common light source 15, and the plurality of light sources 9 includes the common light sources 14 and the non-common light source 15. Therefore, in the relationship between the plurality of light sources 9 and the plurality of reflecting surfaces 13, the degree of freedom of an arrangement of the plurality of light sources can be improved and the degree of freedom of design related to a light distribution can be improved.

Hereinafter, modifications of the lamp unit 5 will be described (see FIGS. 5 to 8).

First, a lamp unit 5A according to a first modification will be described (see FIGS. 5 and 6).

Figure 5:
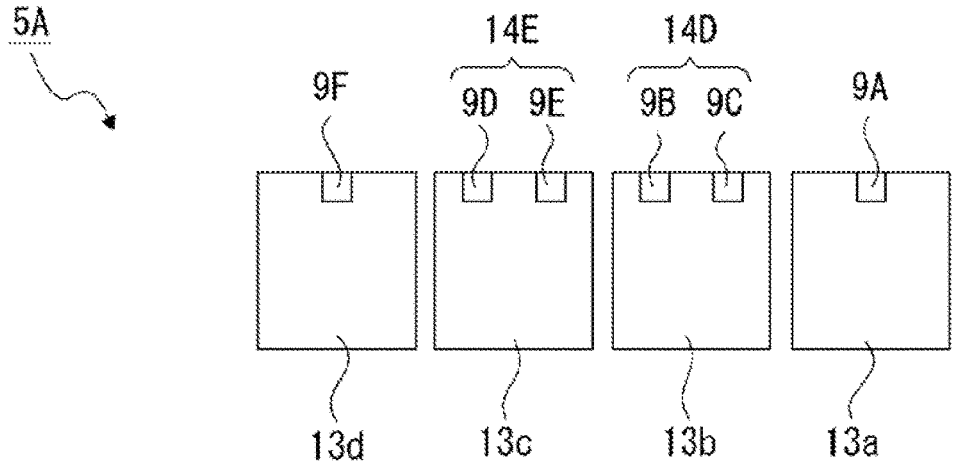
FIG. 5 is a schematic diagram showing an illumination pattern of a lamp unit according to a first modification.

The reflector 7 of the lamp unit 5A is formed with the first reflecting surface 13*a*, the second reflecting surface 13*b*, the third reflecting surface 13*c*, and the fourth reflecting surface 13*d* (see FIG. 5). In the reflector 7, focal lengths of the first reflecting surface 13*a*, the second reflecting surface 13*b*, the third reflecting surface 13*c*, and the fourth reflecting surface 13*d* are set to range, for example, from 10 mm to 15 mm.

For example, six light sources 9, 9 . . . are provided. That is, the number n of the light sources 9 is six. The light sources 9, 9 . . . include the first light source 9A, the third light source 9C, the second light source 9B, the fifth light source 9E, the fourth light source 9D, and the sixth light source 9F in this order from the inner side to the outer side in the left-right direction of the vehicle.

The first light source 9A and the sixth light source 9F are respectively provided as the non-common light sources 15, 15. Light emitted from the first light source 9A travels toward the first reflecting surface 13*a*, and light emitted from the sixth light source 9F travels toward the fourth reflecting surface 13*d*. The third light source 9C and the second light source 9B are provided as a first common light source 14D from which light is emitted toward the second reflecting surface 13*b*, and the fifth light source 9E and the fourth light source 9D are provided as a second common light source 14E from which light is emitted toward the third reflecting surface 13*c*.

Figure 6:
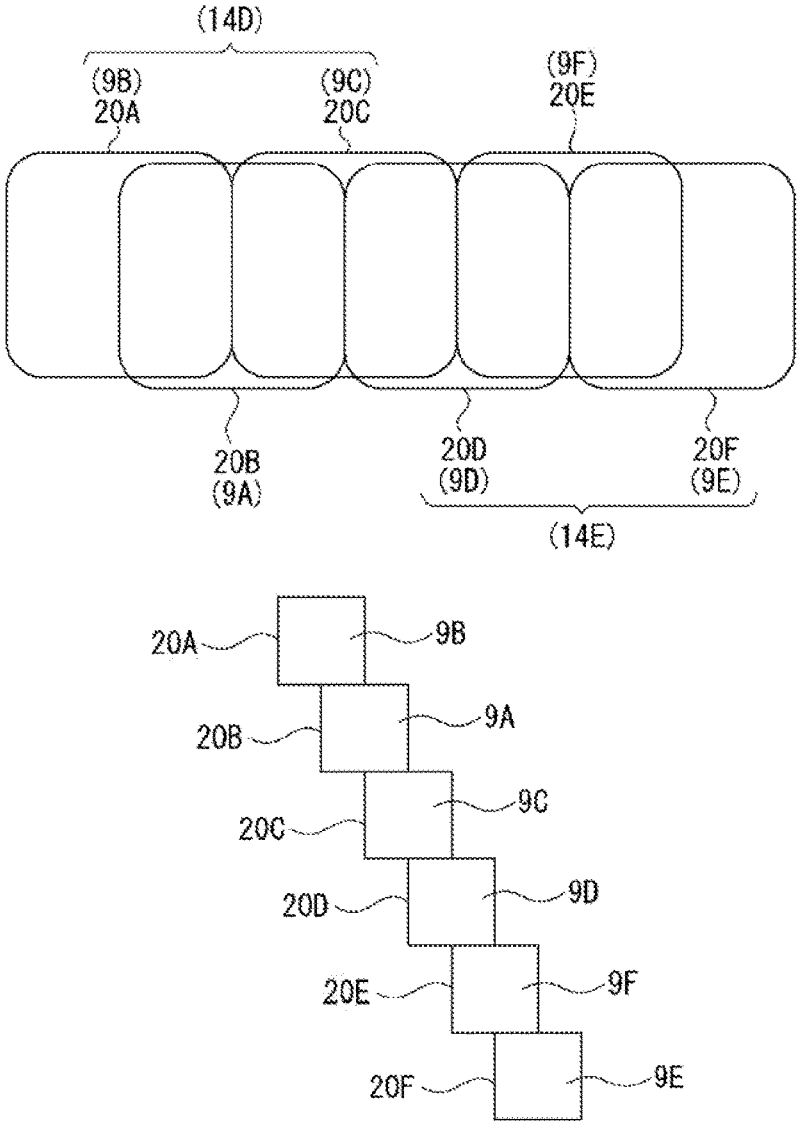
FIG. 6 is a view showing a difference or the like in light sources forming respective illumination patterns in the lamp unit according to the first modification.

In the lamp unit 5A, at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source (see FIG. 6). In FIG. 6, a case where half of areas of illumination patterns overlap one another is described as an example.

Specifically, the illumination patterns 20A, 20C are respectively formed by light which is emitted from the second light source 9B and the third light source 9C and is reflected by the second reflecting surface 13*b*, the illumination pattern 20B is formed by light which is emitted from the light source 9A and is reflected by the first reflecting surface 13*a*, the illumination patterns 20D, 20F are respectively formed by light which is emitted from the fourth light source 9D and the fifth light source 9E and is reflected by the third reflecting surface 13*c*, and the illumination pattern 20E is formed by light which is emitted from the sixth light source 9F and is reflected by the fourth reflecting surface 13*d*.

That is, adjacent illumination patterns 20A, 20C are formed by light emitted from the second light source 9B and the third light source 9C which constitute the first common light source 14D, and adjacent illumination patterns 20D, 20F are formed by the light emitted from the fourth light source 9D and the fifth light source 9E which constitute the second common light source 14E. An overlapping manner of the illumination patterns 20, 20 . . . is similar to the overlapping manner of the lamp unit 5. That is, half of an area of the illumination pattern 20B overlaps half of an area of the illumination pattern 20A, half of an area of the illumination pattern 20C overlaps half of an area of the illumination pattern 20B, half of an area of the illumination pattern 20D overlaps half of an area of the illumination pattern 20C, half of an area of the illumination pattern 20E overlaps half of an area of the illumination pattern 20D, and half of an area of the illumination pattern 20F overlaps half of an area of the illumination pattern 20E.

As described above, in the lamp unit 5A, even in a case where a focal length of a reflecting surface is reduced, if at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source, luminance unevenness is less likely to occur in a light distribution of the vehicle headlamp 1, in a similar manner to the lamp unit 5.

Next, a lamp unit 5B according to a second modification will be described (see FIGS. 7 and 8).

Figure 7:
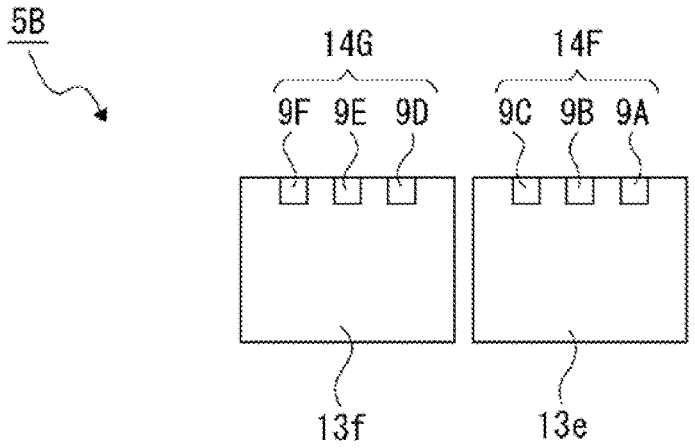
FIG. 7 is a schematic diagram showing an illumination pattern of a lamp unit according to a second modification.

The reflector 7 of the lamp unit 5B is formed with a first reflecting surface 13*e* and a second reflecting surface 13*f* (see FIG. 7). In the reflector 7, focal lengths of the first reflecting surface 13*e* and the second reflecting surface 13*f* are set to range, for example, from 10 mm to 15 mm.

For example, six light sources 9, 9 . . . are provided. That is, the number n of the light sources 9 is six. The light sources 9, 9 . . . include the first light source 9A, the second light source 9B, the third light source 9C, the fourth light source 9D, the fifth light source 9E, and the sixth light source 9F in this order from the inner side to the outer side in the left-right direction of the vehicle.

The first light source 9A, the second light source 9B, and the third light source 9C are provided as a first common light source 14F from which light is emitted toward the first reflecting surface 13*e*, and the fourth light source 9D, the fifth light source 9E, and the sixth light source 9F are provided as a second common light source 14G from which light is emitted toward the second reflecting surface 13*f*.

Figure 8:
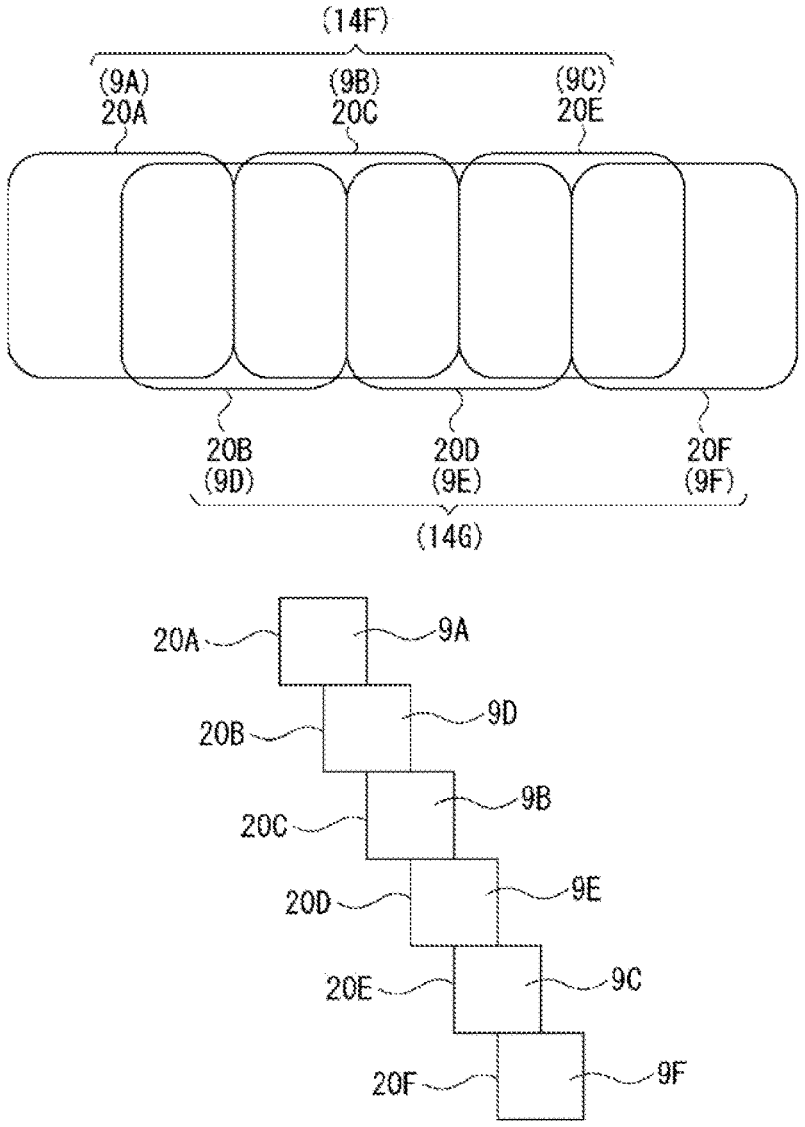
FIG. 8 is a diagram showing a difference or the like in light sources forming respective illumination patterns in the lamp unit according to the second modification.

In the lamp unit 5B, at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source (see FIG. 8). In FIG. 8, a case where half of areas of illumination patterns overlap one another is described as an example.

Specifically, the illumination patterns 20A, 20C, and 20E are respectively formed by light which is emitted from the first light source 9A, the second light source 9B, and the third light source 9C and is reflected by the first reflecting surface 13*e*, and the illumination patterns 20B, 20D, and 20F are respectively formed by light which is emitted from the fourth light source 9D, the fifth light source 9E, and the sixth light source 9F and is reflected by the second reflecting surface 13*f*.

That is, adjacent illumination patterns 20A, 20C and 20E are formed by the light emitted from the first light source 9A, the second light source 9B and the third light source 9C which constitute the first common light source 14F, and adjacent illumination patterns 20B, 20D and 20F are formed by the light emitted from the fourth light source 9D, the fifth light source 9E and the sixth light source 9F which constitute the second common light source 14G. An overlapping manner of the illumination patterns 20, 20 . . . is similar to the overlapping manner of the lamp unit 5. That is, half of an area of the illumination pattern 20B overlaps half of an area of the illumination pattern 20A, half of an area of the illumination pattern 20C overlaps half of an area of the illumination pattern 20B, half of an area of the illumination pattern 20D overlaps half of an area of the illumination pattern 20C, half of an area of the illumination pattern 20E overlaps half of an area of the illumination pattern 20D, and half of an area of the illumination pattern 20F overlaps half of an area of the illumination pattern 20E.

As described above, in the lamp unit 5B, even in a case where a focal length of a reflecting surface is reduced, if at least half of an area of an illumination pattern of an immediately-following number overlaps at least half of an area of an illumination pattern of an immediately-preceding number in the left-right direction, and adjacent illumination patterns which do not overlap each other are formed by light emitted from a common light source, luminance unevenness is less likely to occur in a light distribution of the vehicle headlamp 1, in a similar manner to the lamp unit 5.

Accordingly, in the vehicle headlamp 1 including the lamp unit 5A or the lamp unit 5B, the focal lengths of the reflecting surfaces (13*e*, 13*f*) can be reduced while forming the light distribution pattern 21 in which the luminance unevenness is less likely to occur, and the size of the vehicle headlamp 1 can be reduced while reducing the luminance unevenness in the light distribution pattern 21.

The number of reflecting surfaces and the number of light sources in the vehicle headlamp 1 are not limited to the number of the lamp units 5, 5A and 5B described above, and other configurations may be employed as long as a plurality of reflecting surfaces and a plurality of light sources are provided. In addition, arrangement positions of the light sources relative to the reflecting surfaces are not limited to the arrangement positions of the lamp units 5, 5A and 5B, and a single light source or a plurality of light sources can be arbitrary arranged relative to a plurality of reflecting surfaces.

Although an example where half of an area of an illumination pattern of an immediately-following number overlaps half of an area of an illumination pattern of an immediately-preceding number has been described above, overlapping areas may be substantially half, or overlapping areas may be half or more. The present invention can also be applied to, for example, a case where a light distribution pattern is formed such that a partial area of an illumination pattern of an immediately-following number overlaps a partial area of an illumination pattern of an immediately-preceding number, and areas of the overlapping areas have substantially the same.

REFERENCE SIGNS LIST

1. vehicle headlamp
7. reflector
9. light source
13*a* to 13*g*. reflecting surface
14A to 14G. common light source
15. non-common light source
20A to 20G. illumination pattern
21. light distribution pattern

The invention claimed is:

1. A vehicle headlamp comprising:

a reflector which has a plurality of reflecting surfaces arranged in a left-right direction, each of the plurality of reflective surfaces being a paraboloidal surface which is convex obliquely downward and rearward; and n light sources which are arranged in the left-right direction and each of which is configured to emit light toward any one of the reflecting surfaces, n being at least 3, wherein first and second light sources of the light sources positioned adjacent to each other are provided as a first common light source which is configured to emit light toward a same first reflecting surface, wherein n illumination patterns which illuminate different regions in the left-right direction are formed by light emitted from the n light sources, respectively, wherein the n illumination patterns are taken as a first illumination pattern to an n-th illumination pattern in this order in the left-right direction, wherein at least half of an area of an illumination pattern of an immediately-following number overlaps at least half of an illumination pattern of an immediately-preceding number in the left-right direction, and wherein the first reflecting surface is configured to direct light emitted from the first and second light sources provided as the first common light source such that an illumination pattern formed by the first light source and an illumination pattern formed by the second light source are adjacent illumination patterns which do not overlap each other;

wherein a different second reflective surface of the plurality of reflective surfaces is configured to direct light emitted from a third light source of the light sources such that an illumination pattern formed by the third light source overlaps both of the adjacent illumination patterns formed by the first and second light sources.

2. The vehicle headlamp according to claim 1, wherein focal lengths of each of the plurality of reflective surfaces are set to range from 10 mm to 15 mm.

3. The vehicle headlamp according to claim 1, wherein n is at least 5, and fourth and fifth light sources of the light sources positioned adjacent to each other are provided as a second common light source configured to emit light toward a third reflecting surface.

4. The vehicle headlamp according to claim 1, herein the third light source is provided as a non-common light source in which the third light source is the only light source configured to emit light toward the second reflective surface of the plurality of reflective surfaces.

5. The vehicle headlamp according to claim 1, wherein n is at least 4, and the third light source and a fourth light source of the light sources are positioned adjacent to each other as a second common light source and are configured to emit light toward the second reflecting surface.

* * * * *